US011056038B2

(12) United States Patent
Xu et al.

(10) Patent No.: US 11,056,038 B2
(45) Date of Patent: Jul. 6, 2021

(54) GRAY-SCALE COMPENSATION DEVICE AND METHOD FOR COMBINED PIXELS, AND DISPLAY DEVICE

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Bo Xu, Beijing (CN); Shuai Hou, Beijing (CN); Xinghong Liu, Beijing (CN); Can Zhang, Beijing (CN); Yang Liu, Beijing (CN); Siqing Fu, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 432 days.

(21) Appl. No.: 15/773,790

(22) PCT Filed: Sep. 30, 2017

(86) PCT No.: PCT/CN2017/104932
§ 371 (c)(1),
(2) Date: May 4, 2018

(87) PCT Pub. No.: WO2018/126749
PCT Pub. Date: Jul. 12, 2018

(65) Prior Publication Data

US 2020/0258443 A1 Aug. 13, 2020

(30) Foreign Application Priority Data

Jan. 4, 2017 (CN) ..... 201710005236.8

(51) Int. Cl.
*G09G 3/20* (2006.01)

(52) U.S. Cl.
CPC ... *G09G 3/2007* (2013.01); *G09G 2320/0276* (2013.01)

(58) Field of Classification Search
None
See application file for complete search history.

(56) References Cited

U.S. PATENT DOCUMENTS

2007/0296900 A1 12/2007 Hong
2008/0284719 A1* 11/2008 Yoshida ..... G02F 1/136209 345/102

(Continued)

FOREIGN PATENT DOCUMENTS

CN 101097318 A 1/2008
CN 101312020 A 11/2008

(Continued)

OTHER PUBLICATIONS

International Search Report and Written Opinion dated Dec. 28, 2017; PCT/CN2017/104932.

*Primary Examiner* — Stephen T. Reed

(57) ABSTRACT

A gray-scale compensation device and method for combined pixels, and a display device. The compensation method for the combined pixels includes: measuring a gamma curve of the first pixel group to obtain a first gamma curve; measuring a gamma curve of the second pixel group to obtain a second gamma curve, where an area of the first pixel group is different from an area of the second pixel group; obtaining a compensation voltage based on the first gamma curve and the second gamma curve; and compensating the first pixel group or the second pixel group based on the compensation voltage.

20 Claims, 5 Drawing Sheets

(56) References Cited

U.S. PATENT DOCUMENTS

| | | | | |
|---|---|---|---|---|
| 2012/0307156 | A1* | 12/2012 | Matsuno | H04N 5/144 348/597 |
| 2013/0033588 | A1* | 2/2013 | Shiomi | H04N 21/4318 348/58 |
| 2013/0321483 | A1 | 12/2013 | You et al. | |
| 2014/0071106 | A1 | 3/2014 | Lin et al. | |
| 2016/0104408 | A1* | 4/2016 | Kim | G09G 3/36 345/690 |
| 2017/0206846 | A1* | 7/2017 | Moon | G09G 3/2003 |
| 2017/0213496 | A1 | 7/2017 | Hsu | |

FOREIGN PATENT DOCUMENTS

| | | | |
|---|---|---|---|
| CN | 103456257 | A | 12/2013 |
| CN | 105679798 | A | 6/2016 |
| CN | 106652874 | A | 5/2017 |

* cited by examiner

GRAY-SCALE COMPENSATION DEVICE AND METHOD FOR COMBINED PIXELS, AND DISPLAY DEVICE

TECHNICAL FIELD

Embodiments of the present disclosure relate to a gray-scale compensation device and a gray-scale compensation method for combined pixels, and a display device.

BACKGROUND

A liquid crystal display panel may sometimes have sub-pixels of different sizes; when these sub-pixels of different sizes are combined into pixels, areas of the pixels may be different. The difference in the areas of the pixels may result in difference in aperture ratios and difference in transmission rates, and eventually may cause difference in gray-scale display on the display panel.

SUMMARY

At least an embodiment of the disclosure provides a gray-scale compensation method for combined pixels, the combined pixels including a first pixel group and a second pixel group, the gray-scale compensation method comprising: measuring a gamma curve of the first pixel group to obtain a first gamma curve; measuring a gamma curve of the second pixel group to obtain a second gamma curve, wherein an area of the first pixel group is different from an aperture area of the second pixel group; obtaining a compensation voltage based on the first gamma curve and the second gamma curve; and compensating the first pixel group or the second pixel group based on the compensation voltage.

For example, the first pixel group includes one or more complete pixels; and a total number of pixels included in the first pixel group is equal to a total number of pixels included in the second pixel group.

For example, the second pixel group includes one or more rows of pixels, and each row of pixels includes sub-pixels with a missing area.

For example, the sub-pixels with the missing area are located in a same column and have a same color; and positions corresponding to the sub-pixels with the missing area are provided with common electrode wirings.

For example, measuring the gamma curve of the first pixel group to obtain the first gamma curve, includes: measuring a relationship curve of luminance of the first pixel group and an output voltage with an optical measuring instrument, to obtain the first gamma curve; and measuring the gamma curve of the second pixel group, to obtain the second gamma curve, includes: measuring a relationship curve of luminance of the second pixel group and the output voltage with the optical measuring instrument, to obtain the second gamma curve.

For example, obtaining the compensation voltage based on the first gamma curve and the second gamma curve, includes: obtaining a first gamma look-up table based on the first gamma curve; obtaining a gamma voltage specific to each gray scale, as a reference gamma voltage, according to the first gamma look-up table; obtaining a second gamma look-up table based on the second gamma curve; obtaining a gamma voltage specific to each gray scale, as an intermediate compensation gamma voltage, according to the second gamma look-up table; and obtaining the compensation voltage specific to the first pixel group or the second pixel group, based on the reference gamma voltage and the intermediate compensation gamma voltage.

For example, compensating the first pixel group or the second pixel group based on the compensation voltage, includes: reading, by a timing control circuit, data related to the compensation voltage, and transmitting the data related to the compensation voltage to a data driving circuit in a point-to-point communication mode; and transmitting, by the data driving circuit, the data related to the compensation voltage to a corresponding compensation pixel block.

For example, the gray-scale compensation method further comprises: obtaining a first gamma look-up table based on the first gamma curve; obtaining a reference gamma voltage corresponding to each gray scale according to the first gamma look-up table; and compensating the first pixel group based on the reference gamma voltage.

An embodiment of the disclosure also provides a gray-scale compensation device for combined pixels, the combined pixels including a first pixel group and a second pixel group, and the gray-scale compensation device for the combined pixels comprising: a curve obtaining module, configured to measure a gamma curve of the first pixel group to obtain a first gamma curve, and measure a gamma curve of the second pixel group to obtain a second gamma curve; a processing module, configured to obtain a compensation voltage based on the first gamma curve and the second gamma curve; and a compensating module, configured to compensate the first pixel group or the second pixel group based on the compensation voltage.

For example, the first pixel group includes one or more pixels; and a total number of pixels included in the first pixel group is equal to a total number of pixels included in the second pixel group.

For example, the second pixel group includes one or more rows of pixels, and each row of pixels includes sub-pixels with a missing area.

For example, the sub-pixels with the missing area are located in a same column and have a same color; positions corresponding to the sub-pixels with the missing area are provided with common electrode wirings.

For example, the curve obtaining module is configured to: measure a relationship curve of luminance of the first pixel group and an output voltage with an optical measuring instrument, to obtain the first gamma curve; and measure a relationship curve of luminance of the second pixel group and the output voltage with the optical measuring instrument, to obtain the second gamma curve.

For example, the processing module is configured to: obtain a first gamma look-up table based on the first gamma curve; obtain a gamma voltage specific to each gray scale, as a reference gamma voltage, according to the first gamma look-up table; obtain a second gamma look-up table based on the second gamma curve; obtain a gamma voltage specific to each gray scale, as an intermediate compensation gamma voltage, according to the second gamma look-up table; and obtain a compensation voltage specific to the first pixel group or the second pixel group, based on the reference gamma voltage and the intermediate compensation gamma voltage.

For example, the compensation module is further configured to compensate the first pixel group based on the reference gamma voltage.

An embodiment of the disclosure further provides a display device, comprising the compensation device described above.

BRIEF DESCRIPTION OF THE DRAWINGS

In order to illustrate the technical solutions in the embodiments of the present disclosure more clearly, the drawings needed to be used in the description of the embodiments will be briefly described in the following; it is obvious that the drawings described below are only related to some embodiments of the present disclosure, and are not intended to be limitative to the disclosure.

DETAILED DESCRIPTION

Figure 1A:
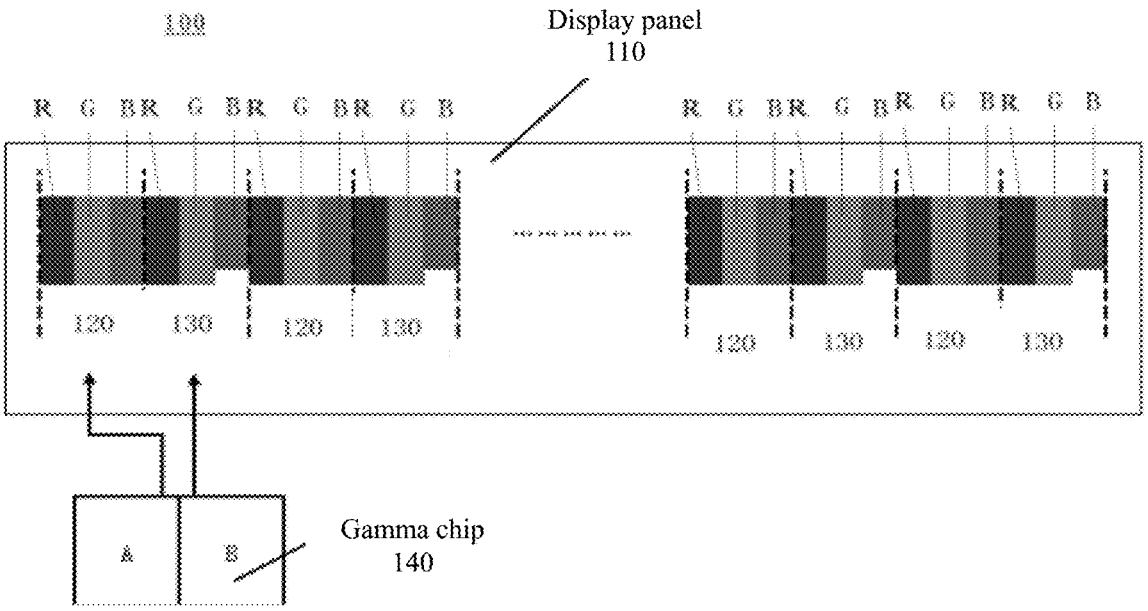
FIG. 1A is a composition schematic diagram of a gray-scale compensation system for combined pixels provided by an embodiment of the present disclosure.

Hereinafter, the technical solutions of the embodiments of the present disclosure will be described in a clearly and fully understandable way in conjunction with the drawings related to the embodiments of the present disclosure; with reference to non-restrictive exemplary embodiments shown in the drawings and described in detail in the following description, exemplary embodiments of the present disclosure and their various features and favorable details are illustrated more comprehensively. It should be noted that, the features shown in the drawings are not necessarily drawn according to scale. Known materials, components and process technologies are not described in the present disclosure so as not to obscure the exemplary embodiments of the present disclosure. Examples given are merely intended to facilitate understanding of implementation of exemplary embodiments of the present disclosure, and further enable those skilled in the art to implement the exemplary embodiments. Therefore, the examples should not be construed as limiting the scope of the exemplary embodiments of the present disclosure.

Unless otherwise defined, technical terms or scientific terms used in the present disclosure should be of general meaning as understood by those ordinarily skilled in the art. "First", "second" and similar words used in the present disclosure do not represent any sequence, quantity or importance and merely intend to differentiate different composite parts. In addition, in respective embodiments of the present disclosure, same or similar reference signs denote same or similar parts.

Hereinafter, specific implementations of a gray-scale compensation system, a gray-scale compensation method and a gray-scale compensation device provided by embodiments of the present disclosure are described in detail below in conjunction with the accompanying drawings.

FIG. 1A shows a gray-scale compensation system 100 provided by an embodiment of the present disclosure. The gray-scale compensation system 100 may comprise a display panel 110, a gamma chip 140, and other elements or apparatuses.

The display panel 110 shown in FIG. 1A includes a plurality of first pixel groups 120 and a plurality of second pixel groups 130. A first pixel group 120 is a first type of combined pixels, a second pixel group 130 is a second type of combined pixels, and the first pixel group 120 and the second pixel group 130 have different aperture areas (for example, a sum of aperture areas of all sub-pixels included in the first pixel group 120 and a sum of aperture areas of all sub-pixels included in the second pixel group 130 are different). For example, the second pixel group 130 in FIG. 1 includes a column of sub-pixels each having a missing area (a sub-pixel having a missing area here refers to, for example, a sub-pixel with an area smaller than an area of a normal sub-pixel), and respective sub-pixels of the first pixel group 120 have no area missing. For example, a position where an aperture area is missing may be provided with a common electrode wiring. In an embodiment of the present disclosure, differentiated gamma compensation may be performed on different combined pixels. For example, the gamma chip 140 shown in FIG. 1 includes an A portion and a B portion, and these two portions may provide gamma compensation for the second pixel group 130 and the first pixel group 120, respectively.

Figure 1B:
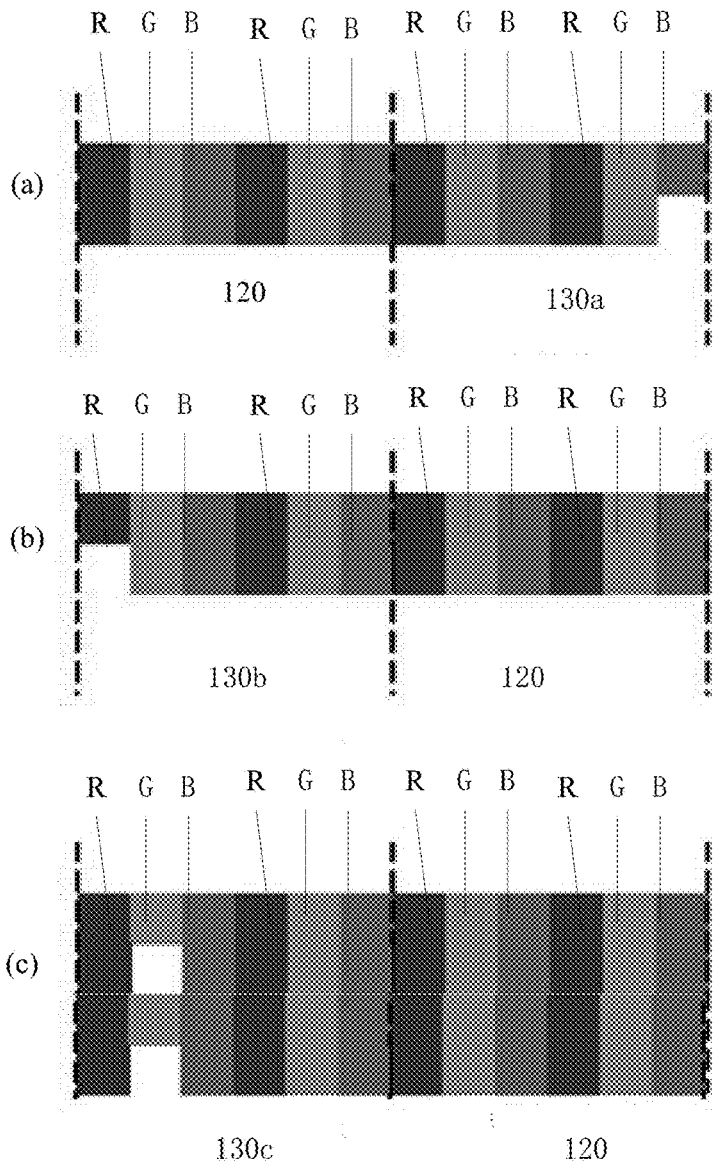
FIG. 1B is a schematic diagram of a first pixel group and a second pixel group provided by an embodiment of the present disclosure.

In some embodiments, as shown in FIG. 1B, a comparison chart of three types of first pixel groups 120 and corresponding second pixel groups 130 is exemplarily provided. With reference to FIG. 1B, it can be seen that the first pixel group 120 and the second pixel group 130 in an embodiment of the present disclosure are pixel combination blocks with different pixel sizes. In addition, a reason why the second pixel group 130 is different from the first pixel group 120 is that there is a difference in the aperture areas of the sub-pixels that form the second pixel group 130 and the aperture areas of the sub-pixels that form the first pixel group 120. The different sub-pixels may be located in a same column, and be of a same color (for example, may be any color of red, green, or blue). In an embodiment of the present disclosure, gray scale compensation may be respectively performed on blocks corresponding to the first pixel group 120 and blocks corresponding to the second pixel group 130, so that the gray scales are consistent, and abnormal display that may occur due to inconsistency of the gray scales caused by inconsistent pixel sizes are eliminated.

The first pixel group 120 and the second pixel group 130 shown in FIG. 1B are only examples of several types of combinations of sub-pixels. In an actual scenario, the first pixel group 120 and the second pixel group 130 may include more combination scenarios of different sub-pixels. In an embodiment of the present disclosure, a combined pixel with no sub-pixel area missing may be taken as a first pixel group 120, and a combined pixel corresponding to sub-pixels having at least one column with missing aperture areas is taken as a second pixel group 130.

In FIG. 1B, the first pixel groups 120 shown in first two rows each include a row of pixels, wherein the row of pixels includes two pixels (each pixel includes three sub-pixels, i.e., RGB). A second pixel group 130*a* shown in a first row (a) includes a row of pixels, where a blue sub-pixel in a last column of the second pixel group 130*a* has an area missing. A second pixel group 130*b* shown in a second row (b) also includes a row of pixels, where a red sub-pixel of the second pixel group 130*b* located in a first column also has an area missing. A third row (c) shows that both the first pixel group 120 and the second pixel group 130*c* include two rows of pixels, where green sub-pixels located in a same column among the two rows of pixels of the second pixel group 130*c* each have an aperture area missing.

In some embodiments, the gamma chip 140 shown in FIG. 1A may respectively generate a compensation voltage specific to the first pixel group 120 or a compensation voltage specific to the second pixel group 130. For example, when obtaining the compensation voltage specific to the second pixel group 130, the gamma chip 140 may obtain it by calculation according to a reference gamma voltage of the first pixel group 120. For example, when obtaining the compensation voltage specific to the first pixel group 120, the gamma chip 140 may obtain it by calculation according to an intermediate compensation gamma voltage of the second pixel group 130. For example, related embodiments provided by FIG. 3 may be referred to.

Figure 1C:
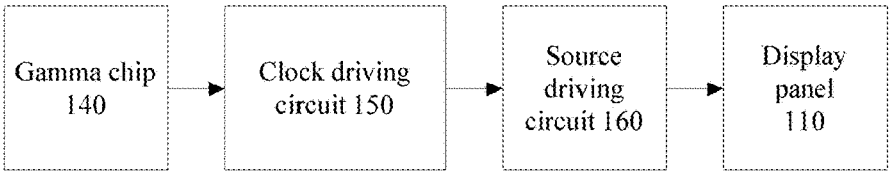
FIG. 1C is another composition schematic diagram of a gray-scale compensation system for combined pixels provided by an embodiment of the present disclosure.

FIG. 1C shows that a gray-scale compensation system provided by an embodiment of the present disclosure may further include a clock driving circuit 150 and a source driving circuit 160. An exemplary connection relationship diagram of the clock driving circuit 150, the source driving circuit 160 and the gamma chip 140 is shown in FIG. 1C. The clock driving circuit 150 shown in FIG. 1C may respectively extract the compensation voltages generated in the gamma chip 140 by using a communication protocol. For example, the clock driving circuit 150 may obtain relevant compensation voltages by using an $I^2C$ communication bus and protocol.

For example, the clock driving circuit 150 shown in FIG. 1C may transmit a reference gamma voltage and a compensation voltage obtained by itself to the source driving circuit 160. Based on the received reference gamma voltage and compensation voltage, the source driving circuit 160 may modify a data signal, and finally input the modified data signal into a certain electrode in a pixel included in the display panel 110, so that a gray-scale voltage loaded on the first pixel group 120 and a gray-scale voltage loaded on the second pixel group 130 of the display device 110 are maintained consistent.

In some embodiments, both the source driving circuit 160 and the clock driving circuit 150 support a point-to-point communication transmission approach.

In summary, in an embodiment of the present disclosure, when a gray scale difference occurs in different combined pixels whose sub-pixels have a difference, it is possible to perform gamma compensation block by block (for example, voltage compensation is performed respectively on a first block corresponding to the first pixel group 120 and a second block corresponding to the second pixel group 130). Due to inconsistency of sub-pixel combinations (for example, the first pixel group 120 and the second pixel group 130 in FIG. 1), there is a difference in pixel aperture areas. In this case, the gamma chip 140 respectively generates a compensation voltage specific to the first pixel group 120 and a compensation voltage specific to the second pixel group 130, and then transmits the compensation voltages to the clock driving circuit 150 via a communication protocol. Then, the clock driving circuit 150 transmits a reference gamma voltage and the compensation voltages to the source driving circuit 160 via a point-to-point communication transmission, and finally, the pixel combinations having a difference (i.e., the first pixel group 120 and the second pixel group 130) are compensated, so as to achieve that gray scales of pixel combinations with different pixel aperture areas are consistent.

Hereinafter, the gray-scale compensation method and the gray-scale compensation device provided by embodiments of the present disclosure are described in conjunction with FIG. 2 to FIG. 4.

Figure 2:
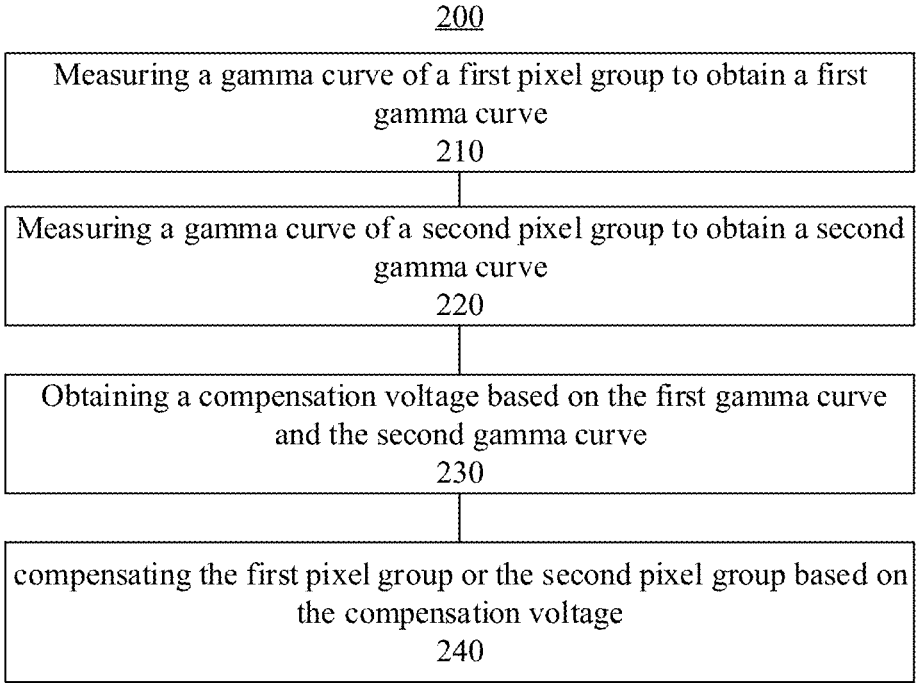
FIG. 2 is a flow chart of a gray-scale compensation method for combined pixels provided by an embodiment of the present disclosure.

As shown in FIG. 2, the diagram provides a gray-scale compensation method 200 for combined pixels. The gray-scale compensation method 200 may comprise: step 210, measuring a gamma curve of a first pixel group, to obtain a first gamma curve; step 220, measuring a gamma curve of a second pixel group, to obtain a second gamma curve, where the second pixel group and the first pixel group have different aperture areas; step 230, obtaining a compensation voltage based on the first gamma curve and the second gamma curve; and step 240, compensating the first pixel group or the second pixel group based on the compensation voltage.

In some embodiments, a first pixel group may include one complete pixel (for example, a reference pixel 120 shown on a display panel of FIG. 1A), or a first pixel group (for example, the first pixel group 120 shown in FIG. 1B) includes a plurality of complete pixels. The so-called complete pixel refers to a pixel whose respective sub-pixels included therein have no area missing. The total number of pixels included in the first pixel group is equal to the total number of pixels included in the second pixel group. For example, both the first pixel group 120 and the second pixel group 130 in FIG. 1A include one pixel (the first pixel group 120 includes one complete pixel, and the second pixel group includes one pixel having an aperture area partially missing). For another example, both the first pixel group 120 and the second pixel group 130 shown in FIG. 1B respectively include two pixels. In addition, the first pixel group 120 and the second pixel group 130 may also respectively include three or more pixels, as long as the total numbers of pixels included in the two are equal to each other.

In some embodiments, the second pixel group includes a plurality of rows of pixels (for example, the second pixel group in the third row (c) shown in FIG. 1B), and pixels in the second pixel group are pixels with an area missing. When the second pixel group includes a plurality of rows of pixels, each row of pixels includes sub-pixels with an aperture area missing, and the respective sub-pixels with an area missing are located in a same column and have a same color. In conjunction with FIG. 1A and FIG. 1B, it can be known that, all the second pixel groups include at least one column of sub-pixels with an area missing, and these sub-pixels are located in a same column and have a same color (for example, the second pixel group 130 in FIG. 1A includes blue sub-pixels with an area missing).

It can be understood that, a complete pixel is relative to a pixel with a missing area; that is, a size of the complete pixel corresponding to the first pixel group is greater than a size of the pixel with a missing area corresponding to the second pixel group.

In some embodiments, measuring a gamma curve of a first pixel group to obtain a first gamma curve in step 210, for example, may include: measuring a relationship curve of luminance of the first pixel group and an output voltage with an optical measuring instrument, to obtain the first gamma curve. Measuring a gamma curve of a second pixel group to obtain a second gamma curve in step 220, for example, may include: measuring a relationship curve of luminance of the second pixel group and an output voltage with the optical measuring instrument, to obtain the second gamma curve.

In some embodiments, the "obtaining a compensation voltage based on the first gamma curve and the second gamma curve" in step 230 may be implemented with reference to the method in FIG. 3 below.

In some embodiments, compensating for the second pixel group based on the compensation voltage in step 240, may include: reading data related to the compensation voltage by a timing control circuit, and transmitting the data related to the compensation voltage to the source driving circuit in a point-to-point communication mode; and transmitting the data related to the compensation voltage to a corresponding compensation block of pixels by the source driving circuit.

In some embodiments, the gray-scale compensation method 200 for combined pixels may further comprise: obtaining a first gamma look-up table based on the first gamma curve; obtaining a reference gamma voltage corresponding to each gray scale according to the first gamma look-up table; compensating the first pixel group based on the reference gamma voltage. At this case, the compensation voltage obtained according to the reference gamma voltage may be used for compensating the second pixel group.

In some embodiments, the gray-scale compensation method 200 for combined pixels may further comprise: obtaining a second gamma look-up table based on the second gamma curve; and obtaining an intermediate compensation gamma voltage corresponding to each gray scale according to the second gamma look-up table; and compensating the second pixel group based on the intermediate gamma compensation voltage. At this case, the compensation voltage obtained according to the intermediate gamma compensation voltage may be used for compensating the first pixel group.

For example, the first gamma curve is a nonlinear effect curve between a voltage input to the first pixel group and an output luminance due to a gamma effect (for example, a power function relation is satisfied between the input voltage and the output luminance Y, for example, a value of v generally ranges from 2.2 to 2.5). Obtaining the first gamma curve is just to determine specific values of Y in the power function, so that the first gamma curve is obtained. According to the first gamma curve, a first gamma correction curve may be obtained; in general, the first gamma correction curve may be used to perform gamma correction on the first gamma curve in a form of inverse gamma (for example, $Y=X^{\gamma}$). Then the reference gamma voltages specific to respective gray scales are obtained according to the first gamma correction curve and the first gamma curve; and finally, the reference gamma voltages specific to respective gray scales form the first gamma look-up table.

For example, the first pixel group has a serial number (0,0) on the display panel, and has three gray scales, which are L2, L1 and L0 respectively; it is assumed that the value of γ obtained by the first gamma curve is 2.2, then the above-described first gamma look-up table is as Table 1. In the column of "reference gamma voltage" in Table 1, the compensation voltage values corresponding to the respective gray scales are listed respectively; the table is only used for indicating that the first gamma look-up table at least includes three columns of contents, and voltage values of the respective gray scales listed with respect to the "reference gamma voltage" column is for illustration only.

TABLE 1

First Gamma Look-up Table

| First pixel group | Gray scale | Reference gamma voltage |
|---|---|---|
| (0, 0) | L2 | 1.8 volts |
| (0, 0) | L1 | 2.5 volts |
| (0, 0) | L0 | 3 volts |

Figure 3:
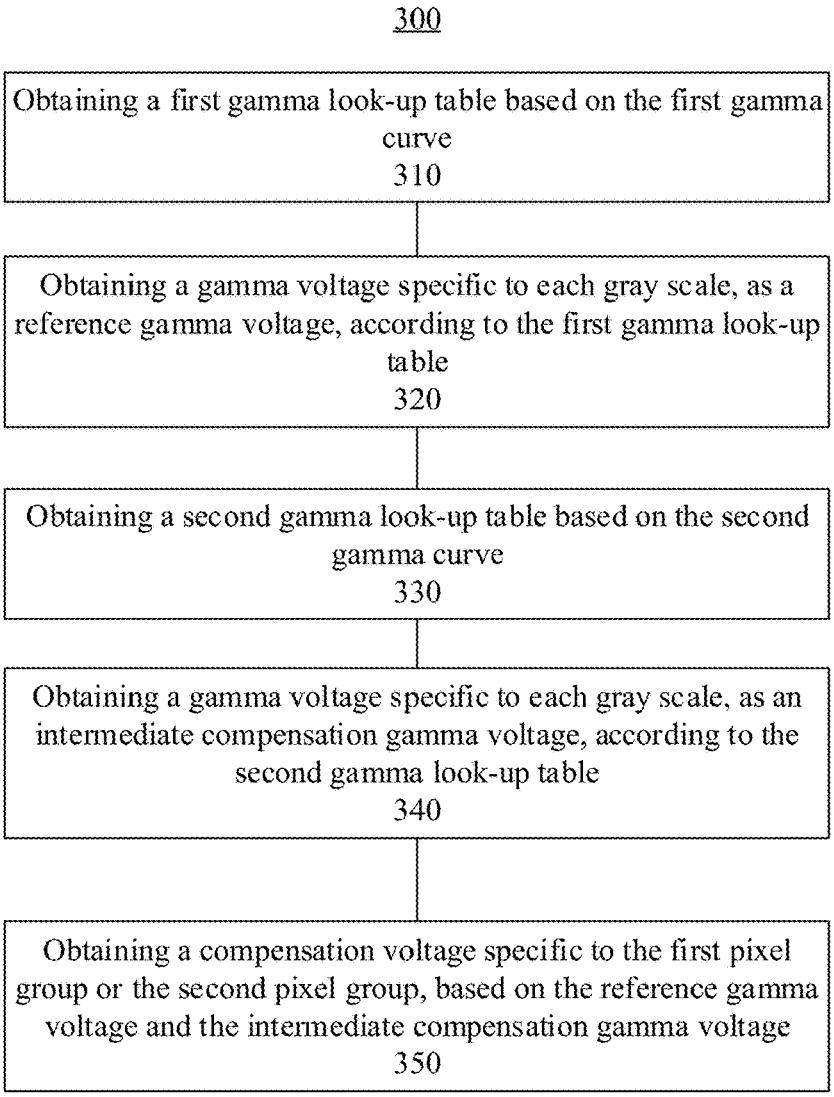
FIG. 3 is another flow chart of a gray-scale compensation method for combined pixels provided an the embodiment of the present disclosure.

As shown in FIG. 3, this example provides a pixel compensation method 300. The pixel compensation method 300 differs from the pixel compensation method 200 shown in FIG. 2 in how to obtain the compensation voltage according to the first gamma curve and the second gamma curve. Related description of FIG. 2 may be referred to for obtaining the first gamma curve or the second gamma curve.

With reference to FIG. 3, the pixel compensation method 300 may comprise: step 310, obtaining a first gamma look-up table based on the first gamma curve; step 320, obtaining a gamma voltage specific to each gray scale according to the first gamma look-up table, as a reference gamma voltage; step 330, obtaining a second gamma look-up table based on the second gamma curve; step 340, obtaining a gamma voltage specific to each gray scale according to the second gamma look-up table, as an intermediate compensation gamma voltage; and step 350, obtaining a compensation voltage specific to the first pixel group or the second pixel group, based on the reference gamma voltage and the intermediate compensation gamma voltage. For example, the compensation voltage may be a difference value between the reference gamma voltage and the intermediate compensation gamma voltage.

For example, in step 330, the second gamma curve is used for reflecting a nonlinear effect curve between the gray-scale voltage inputted to the second pixel group and the display luminance; and obtaining the specific values of Y in the power function is to obtain the second gamma curve. Thereafter, the second gamma correction curve is obtained according to the second gamma curve, and the second gamma look-up table is obtained; and this specific process may be referred to related description of the first gamma look-up table. The second gamma look-up table is similar to the first gamma look-up table in the content included, and difference includes that a serial number of the pixel in the second gamma look-up table should be a serial number of the second pixel group, and that the reference gamma voltage in Table 1 may be replaced by the intermediate compensation gamma voltage obtained according to the second gamma curve.

For example, after the second gamma look-up table is obtained, the reference gamma voltage and the intermediate compensation gamma voltage of the corresponding gray scale in the first gamma look-up table and the second gamma look-up table respectively may be processed (for example, a difference value between the two may be derived), so as to obtain the compensation voltage specific to the second pixel group. The compensation voltage is related to an actual voltage finally loaded for a certain gray scale of the second pixel group (for example, by looking up the first look-up table, a gray-scale voltage for a specific gray scale L2 is obtained to be loaded on the first pixel group, which is 5V; and the compensation voltage obtained by processing according to the first look-up table and the second look-up table is +0.5V, and at this point, when the gray scale L2 needs to be displayed, the gray-scale voltage needs to be loaded on the second pixel group is 5.5V. That is, the actual voltage loaded on the second pixel group may be a sum of the reference gamma voltage of 5V at the same gray scale and the obtained compensation voltage of 0.5V). In addition, relatively, the gray-scale voltage loaded on the first pixel group may also be calculated according to the compensation voltage of 0.5V, and at this point, the gray-scale voltage loaded on the first pixel group may be set to 4.5V (that is, a calculation formula is: 5V-0.5V).

For example, firstly, the reference gamma voltage is obtained, and the intermediate compensation gamma voltage is obtained; secondly, the difference value between the reference gamma voltage and the corresponding intermediate compensation gamma voltage is calculated to obtain the compensation voltage; and finally, the final compensation voltage specific to the second pixel group may be obtained according to the compensation voltage.

In an embodiment of the present disclosure, gray scale compensation may be performed on blocks according to different situations of pixel combination, so as to eliminate a gray-scale difference caused by inconsistent pixel areas, and to implement display without gray-scale difference. For example, it is summarized that: by measuring gamma curves of pixel groups corresponding to different blocks, gamma curves of at least two types of pixel groups (for example, the first pixel group and the second pixel group) having a gamma difference are obtained (wherein the way of measuring the gamma curves is a common measurement practice and manner), and corresponding gamma look-up tables (for example, the first gamma look-up table and the second gamma look-up table) are obtained, and then the obtained first gamma look-up table and the processed second gamma look-up table (i.e., a new look-up table obtained by replacing the intermediate compensation gamma voltage in the second look-up table with the actual loaded voltage obtained based on the obtained compensation voltage, for example, by replacing the intermediate compensation gamma voltage with the voltage of 5.5V obtained in the above-described example) are stored in the gamma chip. When the liquid crystal display panel (TFT-LCD) is illuminated, the data signal starts to be inputted, and at this moment, the clock driving circuit (TCON) may extract the voltage values of the corresponding gray scales specific to different pixel groups in the gamma chip in a communication mode, and transmit the voltage values to the source driving circuit in a point-to-point communication mode. Both the clock driving circuit and the source driving circuit are chips supporting the point-to-point transmission mode. Then, the source driving circuit receives the related data, and then respectively modifies the gamma compensation values of the two pixel groups (for example, the first pixel group and the second pixel group), so that the gray scales of the two blocks corresponding to the two types of pixel groups are consistent. It can be understood that, in order to implement such a gray scale compensation mode performed on blocks with respect to different pixel combinations, the signal transmission mode of the display panel can be point-to-point transmission.

Figure 4:
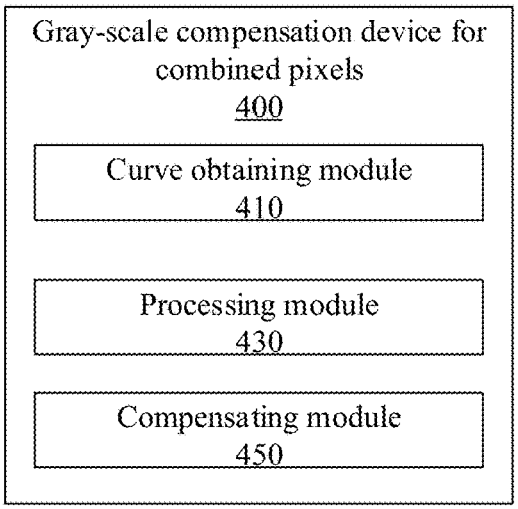
FIG. 4 is a composition block diagram of a gray-scale compensation device for combined pixels provided by an embodiment of the present disclosure.

As shown in FIG. 4, an embodiment of the present disclosure provides a gray-scale compensation device 400 for combined pixels, and the gray-scale compensation device 400 may be used for executing the function of the gamma chip 140 shown in FIG. 1, that is, obtaining a compensation voltage specific to a first pixel group or a second pixel group. In addition, in order to obtain the compensation voltage, it is also needed to obtain an intermediate compensation gamma voltage specific to the second pixel group and obtain a reference gamma voltage specific to the first pixel group. The gray-scale compensation device 400 for combined pixels may comprise: a curve obtaining module 410, configured to measure a gamma curve of the first pixel group to obtain a first gamma curve, and to measure a gamma curve of the second pixel group to obtain a second gamma curve; a processing module 430, configured to obtain a compensation voltage, based on the first gamma curve and the second gamma curve; and a compensating module 450, configured to compensate the first pixel group or the second pixel group based on the compensation voltage. For example, the processing module 430 may be a processor or a single-chip microcomputer, or other devices or units with information processing or computing capabilities.

In some embodiments, the gray-scale compensation device 400 for combined pixels may be located on a gamma chip (for example, the gamma chip 140 shown in FIG. 1A).

In some embodiments, the above-described gray-scale compensation device 400 for combined pixels may start to operate independently before a liquid crystal display starts. When the compensation voltage is obtained, the obtained compensation voltage is supplied to the first pixel group or the second pixel group by a data driving circuit.

In some embodiments, the compensating module 450 may also be located in a source driving circuit.

In some embodiments, the curve obtaining module 410 is further configured to: measure a relationship curve of luminance of the first pixel group and an output voltage using an optical measuring instrument, to obtain a first gamma curve; and measure a relationship curve of luminance of the second pixel group and the output voltage using the optical measuring instrument, to obtain a second gamma curve.

In some embodiments, when a compensation voltage specific to the second pixel group (for example, the second pixel group is a pixel group with an aperture area missing) is to be obtained, the processing module 430 is configured to: obtain a first gamma look-up table based on a first gamma curve; obtain a gamma voltage specific to each gray scale, as a reference gamma voltage, according to the first gamma look-up table; obtain a second gamma look-up table based on a second gamma curve; obtain a gamma voltage specific to each gray scale, as an intermediate compensation gamma voltage, according to the second gamma look-up table; obtain a compensation voltage specific to the second pixel group, based on the reference gamma voltage and the intermediate compensation gamma voltage; where the compensation voltage may be a difference value between the reference gamma voltage and the intermediate compensation gamma voltage. In this case, the reference gamma voltage may be simultaneously used as a gamma correction voltage of the first pixel group. Finally, the reference gamma voltage and the compensation voltage are used for respectively compensating a first block corresponding to the first pixel group and a second block corresponding to the second pixel group, so as to implement differentiated gamma compensation specific to different combined pixel groups.

In some embodiments, when a compensation voltage specific to a first pixel group (for example, the second pixel group is a pixel group with an aperture area missing) is to be obtained, the processing module 430 is configured to: obtain a first gamma look-up table based on a first gamma curve; obtain a gamma voltage specific to each gray scale, as a reference gamma voltage, according to the first gamma look-up table; obtain a second gamma look-up table based on a second gamma curve; obtain a gamma voltage specific to each gray scale, as an intermediate compensation gamma voltage, according to the second gamma look-up table; obtain a compensation voltage specific to the first pixel group, based on the reference gamma voltage and the intermediate compensation gamma voltage; where the compensation voltage may be a difference value between the reference gamma voltage and the intermediate compensation gamma voltage. In this case, the intermediate compensation gamma voltage may be used as a gamma voltage of the second pixel group. Finally, the intermediate compensation gamma voltage and the compensation voltage are used for respectively compensating for a second block corresponding to the second pixel group and a first block corresponding to the first pixel group, so as to implement differentiated gamma compensation specific to different combined pixel groups.

In some embodiments, the gray-scale compensation device 400 for combined pixels may compensate the first pixel group and the second pixel group with aid from a timing control circuit and the data driving circuit.

With reference to the above-described system shown in FIG. 1C, it can be known that, the timing control circuit reads the data related to the compensation voltage that is stored by the processing module 430, and transmits the data related to the compensation voltage to the data driving circuit in a point-to-point communication mode; the data driving circuit transmits the obtained data related to the compensation voltage to the corresponding second pixel group in the point-to-point communication mode.

In some embodiments, the compensating module 450 is further configured to compensate the first pixel group based on the reference gamma voltage.

For example, gamma correction may be performed on the first pixel group with the reference gamma voltage. For example, the first gamma look-up table is obtained based on the above-described first gamma curve; the reference gamma voltage corresponding to each gray scale is obtained according to the first gamma look-up table; and the first pixel group is compensated based on the reference gamma voltage.

For example, the gray-scale compensation device 400 may be used for executing the methods shown in FIG. 2 and FIG. 3, which will not be repeated here in the present disclosure.

Figure 5:
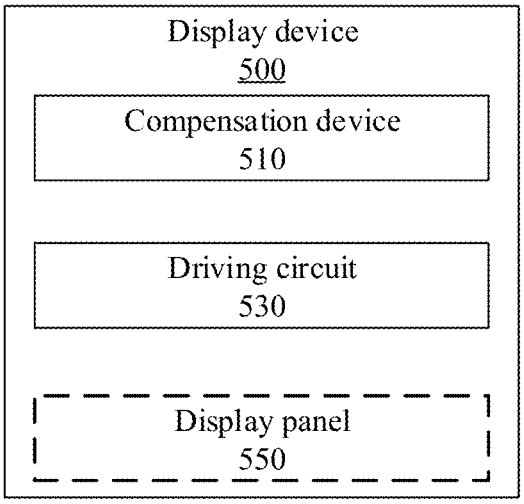
FIG. 5 is a composition block diagram of a display device provided by an embodiment of the present disclosure.

As shown in FIG. 5, the present disclosure provides a display device 500. The display device 500 comprises the above-described compensation device 510. In addition, the display device may further comprise a driving circuit 530, a display panel 550, and the like.

The display panel 550 is provided thereon with a first pixel group and a second pixel group.

The driving circuit 530 may include a timing driving circuit and a source driving circuit. The driving circuit is connected with the compensation device 510, at least for obtaining a compensation voltage obtained by the compensation device. Then, gamma compensation is performed on the first pixel group or the second pixel group on the display panel 550 with the compensation voltage.

In summary, the embodiments of the present disclosure can overcome a problem that uniform gray scale adjustment is performed on entire pixels by a programmable gamma correction buffer circuit chip P-Gamma, which makes it impossible to perform differentiated gray scale adjustment on differentiated pixels.

What are described above is related to the illustrative embodiments of the disclosure only and not limitative to the scope of the disclosure; any changes or replacements easily for those technical personnel who are familiar with this technology in the field to envisage in the scopes of the disclosure, should be in the scope of protection of the present disclosure. Therefore, the scopes of the disclosure are defined by the accompanying claims.

The present application claims the priority of the Chinese Patent Application No. 2017/10005236.8 filed on Jan. 4, 2017, which is incorporated herein by reference in its entirety as part of the disclosure of the present application.

The invention claimed is:

1. A gray-scale compensation method for combined pixels, the combined pixels including a first pixel group and a second pixel group, the gray-scale compensation method comprising:

measuring a gamma curve of the first pixel group to obtain a first gamma curve;

measuring a gamma curve of the second pixel group to obtain a second gamma curve, wherein an aperture area of the first pixel group is different from an aperture area of the second pixel group;

obtaining a compensation voltage based on the first gamma curve and the second gamma curve; and compensating the first pixel group or the second pixel group based on the compensation voltage.

2. The gray-scale compensation method for the combined pixels according to claim 1, wherein:

the first pixel group includes one or more complete pixels; and a total number of pixels included in the first pixel group is equal to a total number of pixels included in the second pixel group.

3. The gray-scale compensation method for the combined pixels according to claim 1, wherein:

the second pixel group includes one or more rows of pixels, and each row of pixels includes sub-pixels with an area smaller than an area of a sub-pixel included in the first pixel group.

4. The gray-scale compensation method for the combined pixels according to claim 3, wherein the sub-pixels with the area smaller than the area of the sub-pixel included in the first pixel group are located in a same column and have a same color; and positions corresponding to the sub-pixels with the area smaller than the area of the sub-pixel included in the first pixel group are provided with common electrode wirings.

5. The gray-scale compensation method for the combined pixels according to claim 1, wherein:

measuring the gamma curve of the first pixel group to obtain the first gamma curve, includes:

measuring a relationship curve of luminance of the first pixel group and an output voltage with an optical measuring instrument, to obtain the first gamma curve; and measuring the gamma curve of the second pixel group, to obtain the second gamma curve, includes:

measuring a relationship curve of luminance of the second pixel group and the output voltage with the optical measuring instrument, to obtain the second gamma curve.

6. The gray-scale compensation method for the combined pixels according to claim 1, wherein:

obtaining the compensation voltage based on the first gamma curve and the second gamma curve, includes:

obtaining a first gamma look-up table based on the first gamma curve;

obtaining a gamma voltage specific to each gray scale, as a reference gamma voltage, according to the first gamma look-up table;

obtaining a second gamma look-up table based on the second gamma curve;

obtaining a gamma voltage specific to each gray scale, as an intermediate compensation gamma voltage, according to the second gamma look-up table; and obtaining the compensation voltage specific to the first pixel group or the second pixel group, based on the reference gamma voltage and the intermediate compensation gamma voltage.

7. The gray-scale compensation method for the combined pixels according to claim 1, wherein:

compensating the first pixel group or the second pixel group based on the compensation voltage, includes:

reading, by a timing control circuit, data related to the compensation voltage, and transmitting the data related to the compensation voltage to a data driving circuit in a point-to-point communication mode; and transmitting, by the data driving circuit, the data related to the compensation voltage to a corresponding compensation pixel block.

8. The gray-scale compensation method for the combined pixels according to claim 1, further comprising:

obtaining a first gamma look-up table based on the first gamma curve;

obtaining a reference gamma voltage corresponding to each gray scale according to the first gamma look-up table; and compensating the first pixel group based on the reference gamma voltage.

9. The gray-scale compensation method for the combined pixels according to claim 2, wherein the second pixel group includes one or more rows of pixels, and each row of pixels includes sub-pixels with a missing area.

10. The gray-scale compensation method for the combined pixels according to claim 2, wherein measuring the gamma curve of the first pixel group to obtain the first gamma curve, includes:

measuring a relationship curve of luminance of the first pixel group and an output voltage with an optical measuring instrument, to obtain the first gamma curve; and measuring the gamma curve of the second pixel group, to obtain the second gamma curve, includes:

measuring a relationship curve of luminance of the second pixel group and the output voltage with the optical measuring instrument, to obtain the second gamma curve.

11. The gray-scale compensation method for the combined pixels according to claim 2, wherein obtaining the compensation voltage based on the first gamma curve and the second gamma curve, includes:

obtaining a first gamma look-up table based on the first gamma curve;

obtaining a gamma voltage specific to each gray scale, as a reference gamma voltage, according to the first gamma look-up table;

obtaining a second gamma look-up table based on the second gamma curve;

obtaining a gamma voltage specific to each gray scale, as an intermediate compensation gamma voltage, according to the second gamma look-up table; and obtaining the compensation voltage specific to the first pixel group or the second pixel group, based on the reference gamma voltage and the intermediate compensation gamma voltage.

12. The gray-scale compensation method for the combined pixels according to claim 2, wherein compensating the first pixel group or the second pixel group based on the compensation voltage, includes:

reading, by a timing control circuit, data related to the compensation voltage, and transmitting the data related to the compensation voltage to a data driving circuit in a point-to-point communication mode; and transmitting, by the data driving circuit, the data related to the compensation voltage to a corresponding compensation pixel block.

13. The gray-scale compensation method for the combined pixels according to claim 2, further comprising:

obtaining a first gamma look-up table based on the first gamma curve;

obtaining a reference gamma voltage corresponding to each gray scale according to the first gamma look-up table; and compensating the first pixel group based on the reference gamma voltage.

14. A gray-scale compensation device for combined pixels, the combined pixels including a first pixel group and a second pixel group, and the gray-scale compensation device for the combined pixels comprising:

a curve obtaining module, configured to:

measure a gamma curve of the first pixel group to obtain a first gamma curve; and measure a gamma curve of the second pixel group to obtain a second gamma curve, wherein an aperture area of the first pixel group is different from an aperture area of the second pixel group;

a processing module, configured to obtain a compensation voltage based on the first gamma curve and the second gamma curve; and a compensating module, configured to compensate the first pixel group or the second pixel group based on the compensation voltage.

15. The gray-scale compensation device for the combined pixels according to claim 14, wherein:

the first pixel group includes one or more pixels; and a total number of pixels included in the first pixel group is equal to a total number of pixels included in the second pixel group.

16. The gray-scale compensation device for the combined pixels according to claim 14, wherein:

the second pixel group includes one or more rows of pixels, and each row of pixels includes sub-pixels with an area smaller than an area of a sub-pixel included in the first pixel group.

17. The gray-scale compensation device for the combined pixels according to claim 16, wherein the sub-pixels with the area smaller than the area of the sub-pixel included in the first pixel group are located in a same column and have a same color;

positions corresponding to the sub-pixels with the area smaller than the area of the sub-pixel included in the first pixel group are provided with common electrode wirings.

18. The gray-scale compensation device for the combined pixels according to claim 14, wherein:

the curve obtaining module is configured to:

measure a relationship curve of luminance of the first pixel group and an output voltage with an optical measuring instrument, to obtain the first gamma curve; and measure a relationship curve of luminance of the second pixel group and the output voltage with the optical measuring instrument, to obtain the second gamma curve.

19. The gray-scale pixel compensation device for the combined pixels according to claim 14, wherein:

the processing module is configured to:

obtain a first gamma look-up table based on the first gamma curve;

obtain a gamma voltage specific to each gray scale, as a reference gamma voltage, according to the first gamma look-up table;

obtain a second gamma look-up table based on the second gamma curve;

obtain a gamma voltage specific to each gray scale, as an intermediate compensation gamma voltage, according to the second gamma look-up table; and obtain a compensation voltage specific to the first pixel group or the second pixel group, based on the reference gamma voltage and the intermediate compensation gamma voltage.

20. A display device, comprising the compensation device according to claim 14.

* * * * *